US012458057B2

(12) United States Patent
Rees et al.

(10) Patent No.: US 12,458,057 B2
(45) Date of Patent: Nov. 4, 2025

(54) AEROSOL-GENERATING COMPRISING AN AMORPHOUS SOLID WITH ALGINATE AND PECTIN AS GELLING AGENTS

(71) Applicant: NICOVENTURES TRADING LIMITED, London (GB)

(72) Inventors: Kelly Rees, London Greater London (GB); Thomas Leah, London Greater London (GB); Richard Todd, London Greater London (GB)

(73) Assignee: NICOVENTURES TRADING LIMITED, London (GB)

( * ) Notice: Subject to any disclaimer, the term of this patent is extended or adjusted under 35 U.S.C. 154(b) by 458 days.

(21) Appl. No.: 17/780,314

(22) PCT Filed: Nov. 27, 2020

(86) PCT No.: PCT/EP2020/083794
§ 371 (c)(1),
(2) Date: May 26, 2022

(87) PCT Pub. No.: WO2021/105472
PCT Pub. Date: Jun. 3, 2021

(65) Prior Publication Data

US 2023/0000135 A1 Jan. 5, 2023

(30) Foreign Application Priority Data

Nov. 29, 2019 (GB) ..... 1917469

(51) Int. Cl.

| | |
|---|---|
| ***A24B 15/30*** | (2006.01) |
| ***A24B 15/167*** | (2020.01) |
| ***A24C 5/01*** | (2020.01) |
| ***A24D 1/20*** | (2020.01) |
| ***A24F 40/20*** | (2020.01) |

(52) U.S. Cl.
CPC ..... *A24B 15/303* (2013.01); *A24B 15/167* (2016.11); *A24C 5/01* (2020.01); *A24D 1/20* (2020.01); *A24F 40/20* (2020.01)

(58) Field of Classification Search
CPC ..... A24B 15/167; A24B 15/303; A24C 5/01; A24D 1/20; A24F 40/20
See application file for complete search history.

(56) References Cited

U.S. PATENT DOCUMENTS

| | | | | |
|---|---|---|---|---|
| 5,369,723 | A | 11/1994 | Counts et al. | |
| 6,408,856 | B1 * | 6/2002 | McAdam | A24B 15/16 131/275 |
| 2007/0215167 | A1 | 9/2007 | Llewellyn et al. | |
| 2007/0237724 | A1 | 10/2007 | Abram et al. | |
| 2014/0360518 | A1 * | 12/2014 | Besso | A24D 3/061 131/332 |
| 2015/0034099 | A1 * | 2/2015 | Besso | A24B 15/32 131/328 |
| 2020/0037663 | A1 * | 2/2020 | Chau | H05B 3/44 |

FOREIGN PATENT DOCUMENTS

| | | | | |
|---|---|---|---|---|
| CN | 1050491 | A | 4/1991 | |
| CN | 106998811 | A | 8/2017 | |
| CN | 107846963 | A | 3/2018 | |
| CN | 108968154 | A * | 12/2018 | A24F 40/20 |
| RU | 2604313 | C2 | 12/2016 | |
| WO | WO-9732490 | A1 | 9/1997 | |
| WO | 03092416 | A1 | 11/2003 | |
| WO | WO-2009021018 | A1 | 2/2009 | |
| WO | 2013/022936 | A1 | 2/2013 | |
| WO | 2013034488 | A2 | 3/2013 | |
| WO | 2015062983 | A2 | 5/2015 | |
| WO | 2016135331 | A1 | 9/2016 | |
| WO | WO-2016184978 | A1 | 11/2016 | |
| WO | WO-2017097840 | A1 | 6/2017 | |
| WO | 2019/161089 | A1 | 8/2019 | |
| WO | WO-2020025723 | A1 | 2/2020 | |

OTHER PUBLICATIONS

International Preliminary Report on Patentability for Application No. PCT/EP2020/083794, mailed on Jun. 9, 2022, 9 pages.
International Search Report and Written Opinion for Application No. PCT/EP2020/083794 mailed on Feb. 19, 2021, 11 pages.
James P. Casey, "Pulp and Paper: Chemistry and Chemical Technology," light industrial press, Jul. 31, 1959, pp. 598, vol. 1.

* cited by examiner

*Primary Examiner* — Michael H. Wilson
*Assistant Examiner* — Adam Z Baratz
(74) *Attorney, Agent, or Firm* — WOMBLE BOND DICKINSON (US) LLP

(57) ABSTRACT

An aerosol-generating material including an amorphous solid, wherein the amorphous solid includes 1-60 wt % of a gelling agent; 5-80 wt % of an aerosol-former material; and 10-60 wt % of an active substance; wherein these weights are calculated on a dry weight basis, and wherein the gelling agent includes alginate and pectin, wherein a ratio of the alginate to the pectin is from 1:1 to 10:1.

22 Claims, 7 Drawing Sheets

AEROSOL-GENERATING COMPRISING AN AMORPHOUS SOLID WITH ALGINATE AND PECTIN AS GELLING AGENTS

The present application is a National Phase entry of PCT Application No. PCT/EP2020/083794, filed Nov. 27, 2020, which claims priority from GB Patent Application No. 1917469.7, filed Nov. 29, 2019, which is hereby fully incorporated herein by reference.

TECHNICAL FIELD

The present invention relates to aerosol generation.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles or aerosol generating assemblies.

One example of such a product is a heating device which release compounds by heating, but not burning, a solid aerosol-generating material. This solid aerosol-generating material may, in some cases, contain a tobacco material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosol-generating material are known.

As another example, there are e-cigarette/tobacco heating product hybrid devices, also known as electronic tobacco hybrid devices. These hybrid devices contain a liquid source (which may or may not contain nicotine) which is vaporised by heating to produce an inhalable vapor or aerosol. The device additionally contains a solid aerosol-generating material (which may or may not contain a tobacco material) and components of this material are entrained in the inhalable vapor or aerosol to produce the inhaled medium.

SUMMARY

According to a first aspect of the present invention, there is provided an aerosol-generating material comprising an amorphous solid, wherein the amorphous solid comprises:

1-60 wt % of a gelling agent; and 5-80 wt % of an aerosol-former material; and 10-60 wt % of an active substance;

wherein these weights are calculated on a dry weight basis, and wherein the gelling agent comprises alginate and pectin, wherein a ratio of the alginate to the pectin is from 1:1 to 10:1.

According to a second aspect of the present invention, there is provided a substrate comprising an aerosol-generating material as described herein and a support on which the aerosol-generating material is provided.

According to a third aspect of the present invention, there is provided an article for use within a non-combustible aerosol provision device, the article comprising an aerosol-generating material as described herein and/or a substrate as described herein.

According to a further aspect of the present invention, there is provided a non-combustible aerosol provision system comprising an article as described herein and a non-combustible aerosol provision device, wherein the non-combustible aerosol provision device is configured to generate aerosol from the article when the article is used with the non-combustible aerosol provision device.

According to a further aspect of the present invention, there is provided a method of making an aerosol-generating material as described herein.

According to a further aspect of the present invention, there is provided a method of generating an aerosol using a non-combustible aerosol provision system as described herein, the method comprising heating the aerosol-generating material. In some embodiments, the method comprises heating the aerosol-generating material to a temperature of less than or equal to 350° C. In some embodiments, the method comprises heating the aerosol-generating material to a temperature of from about 220° C. to about 280° C.

According to a further aspect of the present invention, there is provided use of a non-combustible aerosol provision system as described herein.

Further features and advantages of the invention will become apparent from the following description of preferred embodiments of the invention, given by way of example only, which is made with reference to the accompanying drawings.

DETAILED DESCRIPTION

Figure 1:
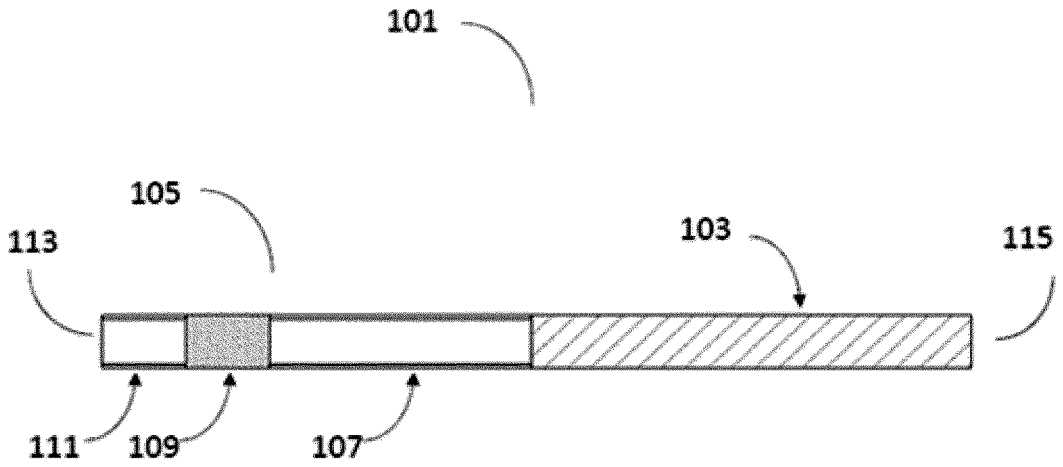
FIG. 1 shows a section view of an example of an aerosol-generating article.

The aerosol-generating material described herein is material that is capable of generating aerosol, for example when heated, irradiated or energized in any other way. Aerosol-generating material may, for example, be in the form of a solid, liquid or gel which may or may not contain nicotine and/or flavorants. The aerosol-generating material comprises an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid. In some cases, the aerosol generating material consists of amorphous solid.

As described hereinabove, the invention provides an aerosol-generating material comprising an amorphous solid, wherein the amorphous solid comprises:

1-60 wt % of a gelling agent; and 5-80 wt % of an aerosol-former material; and 10-60 wt % of an active substance;

wherein these weights are calculated on a dry weight basis, and wherein the gelling agent comprises alginate and pectin, wherein a ratio of the alginate to the pectin is from 1:1 to 10:1. The ratio of alginate to pectin is expressed as a dry weight ratio (w/w).

The inventors have established that providing a gelling agent comprising alginate and pectin in such ratios may provide an improved substrate. Without wishing to be bound by theory, it is believed that a combination of alginate and pectin may have a synergistic effect on the binding in the amorphous solid. Further, combining alginate and pectin in particular ratios may influence the temperature at which an active substance is released from the amorphous solid when heated and/or the point in a session of use at which the active substance is released Providing a gelling agent which comprises more alginate than pectin may be advantageous due to lower material costs. However, a gelling agent comprising alginate alone may have a high viscosity, meaning that it is difficult to process the gelling agent during the manufacture of the substrate. The inventors have identified that, by combining alginate with pectin, and particularly by combining alginate with pectin wherein pectin is present as a minority portion, the viscosity of the gelling agent may be easier to process during the manufacture of the substrate.

The ratio of the alginate to the pectin is from 1:1 to 10:1. In some embodiments, the ratio of the alginate to the pectin is >1:1. That is, in some embodiments, the alginate is present in an amount greater than the amount of pectin. In some embodiments, the ratio of alginate to pectin is from 2:1 to 8:1, or 3:1 to 8:1, or 3:1 to 6:1, or is approximately 4:1. In some embodiments, the ratio of alginate to pectin is from 5:1 to 7:1.

In some embodiments, the alginate is comprised in the gelling agent in an amount of from 15-40 wt % of the amorphous solid. That is, the amorphous solid comprises alginate in an amount of 15-40 wt % by dry weight of the amorphous solid. In some embodiments, the amorphous solid comprises alginate in an amount of from 10-35 wt %, or 15 wt % to 30 wt %.

In some embodiments, the pectin is comprised in the gelling agent in an amount of from 3-10 wt % of the amorphous solid. That is, the amorphous solid comprises pectin in an amount of 3-10 wt % by dry weight of the amorphous solid. In some embodiments, the amorphous solid comprises pectin in an amount of from 3-8 wt %, or 4 wt % to 6 wt %.

Suitably, the amorphous solid may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of gelling agent (all calculated on a dry weight basis). For example, the amorphous solid may comprise 1-50 wt %, 5-40 wt %, or 25-35 wt % of a gelling agent.

In some embodiments, the gelling agent further comprises a hydrocolloid other than those mentioned above. In some embodiments, the gelling agent further comprises one or more compounds selected from the group comprising starches (and derivatives), celluloses (and derivatives, such as such as methylcellulose, hydroxypropyl cellulose, and carboxymethyl cellulose (CMC)), gums, silica or silicones compounds, clays, polyvinyl alcohol and combinations thereof. For example, in some embodiments, the gelling agent further comprises one or more of hydroxyethyl cellulose, hydroxypropyl cellulose, carboxymethylcellulose, pullulan, xanthan gum, guar gum, carrageenan, agarose, acacia gum, fumed silica, PDMS, sodium silicate, kaolin and polyvinyl alcohol.

The gelling agent may further comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent further comprises one or more of hydroxyethyl cellulose, hydroxypropyl cellulose, hydroxypropyl methylcellulose (HPMC), carboxymethylcellulose, guar gum, or acacia gum.

In some embodiments, the gelling agent further comprises one or more non-cellulosic gelling agents, including, but not limited to, agar, xanthan gum, gum Arabic, guar gum, locust bean gum, carrageenan, starch, and combinations thereof. In preferred embodiments, the non-cellulose based gelling agent further comprises agar.

The aerosol-generating material may comprise one or more active substances, one or more aerosol-former materials and optionally one or more other functional constituents. In some cases, the amorphous solid may comprise from about 1 wt %, 5 wt %, 10 wt %, 15 wt %, 20 wt % or 25 wt % to about 70 wt %, 50 wt %, 45 wt % or 40 wt % (calculated on a dry weight basis) of active substance.

In particular embodiments, the amorphous solid comprises 10-60 wt %, 40-60 wt % or 45-55 wt % of active substance. In these embodiments, the active substance may consist essentially of menthol, or comprise menthol in an amount of at least 90% by weight of the active substance, or of at least 95 wt % by weight of the active substance.

The active substance may comprise a physiologically and/or olfactory active substance which is included in the aerosol-generating material in order to achieve a physiological and/or olfactory response. The active substance may for example be selected from nutraceuticals, nootropics, and psychoactives. The active substance may be naturally occurring or synthetically obtained. The active substance may comprise for example nicotine, caffeine, taurine, theine, a vitamin such as B6 or B12 or C, melatonin, a cannabinoid, or a constituent, derivative, or combinations thereof. In some embodiments, the active substance comprises nicotine. In some embodiments, the active substance comprises caffeine, melatonin or vitamin B12. The active substance may comprise a constituent, derivative or extract of tobacco or of another botanical such as cannabis, such as a cannabinoid or terpene. In some embodiments, the active substance is a physiologically active substance and may be selected from nicotine, nicotine salts (e.g. nicotine ditartrate/nicotine bitartrate), nicotine-free tobacco substitutes, other alkaloids such as caffeine, cannabinoids, or mixtures thereof. Cannabinoids are a class of natural or synthetic chemical compounds which act on cannabinoid receptors (i.e., CB1 and CB2) in cells that repress neurotransmitter release in the brain. Two of the most important cannabinoids are tetrahydrocannabinol (THC) and cannabidiol (CBD). Cannabinoids may be naturally occurring (Phytocannabinoids) from plants such as cannabis, (endocannabinoids) from animals, or artificially manufactured (Synthetic cannabinoids). Cannabinoids are cyclic molecules exhibiting particular properties such as the ability to easily cross the blood-brain barrier, weak toxicity, and few side effects. Cannabis species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in cannabis include, without limitation: cannabigerol (CBG), cannabichromene (CBC), cannabidiol (CBD), tetrahydrocannabinol (THC), cannabinol (CBN) and cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

In some embodiments, the active substance is an olfactory active substance and may be selected from a "flavor" and/or "flavorant" which, where local regulations permit, may be used to create a desired taste, aroma or other somatosensorial sensation in a product for adult consumers. In some instances such constituents may be referred to as flavors, flavorants, cooling agents, heating agents, or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The term botanical includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha spicata crispa, Mentha cordifolia, Mentha longifolia, Mentha suaveolens variegata, Mentha pulegium, Mentha spicata* c.v. and *Mentha suaveolens*. In some embodiments, the botanical is selected from eucalyptus, star anise, cocoa and hemp. In some embodiments, the botanical is selected from rooibos and fennel.

In some embodiments, the active substance comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The active substance may comprise one or more cannabinoid compounds selected from the group consisting of cannabidiol (CBD) and THC (tetrahydrocannabinol).

The active substance may comprise cannabidiol (CBD).

The active substance may comprise nicotine and cannabidiol (CBD).

The active substance may comprise nicotine, cannabidiol (CBD), and THC (tetrahydrocannabinol).

The aerosol-generating material, or the amorphous solid, may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the aerosol-generating material or the amorphous solid comprises nicotine. In such embodiments, the presence of an acid may stabilise dissolved species in the slurry from which the aerosol-generating material or the amorphous solid is formed. The presence of the acid may reduce or substantially prevent evaporation of nicotine during drying of the slurry, thereby reducing loss of nicotine during manufacturing.

In certain embodiments, the aerosol-generating material or the amorphous solid comprises a gelling agent comprising a cellulosic gelling agent and/or a non-cellulosic gelling agent, an active substance and an acid.

The amorphous solid comprises 5-80 wt % aerosol-former material. In some embodiments, the amorphous solid comprises 10-30 wt % aerosol-former material, or 15-25 wt % aerosol-former material.

In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

The amorphous solid may have any suitable water content, such as from 1 wt % to 15 wt %. Suitably, the water content of the amorphous solid may be from about 5 wt %, 7 wt % or 9 wt % to about 15 wt %, 13 wt % or 11 wt % (WWB). The water content of the amorphous solid may, for example, be determined by Karl-Fischer-titration or Gas Chromatography with Thermal Conductivity Detector (GC-TCD).

In some cases, the amorphous solid comprises:

20-35 wt % of the gelling agent;

15-25 wt % of the aerosol-former material;

45-55 wt % of the active substance, the active substance consisting essentially of menthol;

wherein these weights are calculated on a dry weight basis, and wherein the ratio of alginate to pectin in the gelling agent is from 5:1 to 7:1.

The amorphous solid may comprise a colorant. The addition of a colorant may alter the visual appearance of the amorphous solid. The presence of colorant in the amorphous solid may enhance the visual appearance of the amorphous solid and the aerosol-generating material. By adding a colorant to the amorphous solid, the amorphous solid may be color-matched to other components of the aerosol-generating material or to other components of an article comprising the amorphous solid.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

The aerosolizable or non-aerosol-generating material may be present on or in a support to form a substrate. The support functions as a support on which the amorphous solid layer forms, easing manufacture. The support may provide rigidity to the amorphous solid layer, easing handling.

The support may be any suitable material which can be used to support an amorphous solid. In some cases, the support may be formed from materials selected from metal foil, paper, carbon paper, greaseproof paper, ceramic, carbon allotropes such as graphite and graphene, plastic, cardboard, wood or combinations thereof. In some cases, the support may comprise or consist of a tobacco material, such as a sheet of reconstituted tobacco. In some cases, the support may be formed from materials selected from metal foil, paper, cardboard, wood or combinations thereof. In some cases, the support comprises paper. In some cases, the support itself be a laminate structure comprising layers of materials selected from the preceding lists. In some cases, the support may also function as a flavor support. For example, the support may be impregnated with a flavorant or with tobacco extract.

Suitably, the thickness of the support layer may be in the range of about 10 μm, 15 μm, 17 μm, 20 μm, 23 μm, 25 μm, 50 μm, 75 μm or 0.1 mm to about 2.5 mm, 2.0 mm, 1.5 mm, 1.0 mm or 0.5 mm. The support may comprise more than one layer, and the thickness described herein refers to the aggregate thickness of those layers.

In some cases, the support may be magnetic. This functionality may be used to fasten the support to the assembly in use, or may be used to generate particular amorphous solid shapes. In some cases, the aerosol generating substrate may comprise one or more magnets which can be used to fasten the substrate to an induction heater in use.

In some cases, the support may be substantially or wholly impermeable to gas and/or aerosol. This prevents aerosol or gas passage through the support layer, thereby controlling the flow and ensuring it is delivered to the user. This can also be used to prevent condensation or other deposition of the gas/aerosol in use on, for example, the surface of a heater provided in an aerosol generating assembly. Thus, consumption efficiency and hygiene can be improved in some cases.

In some cases, the surface of the support that abuts the amorphous solid may be porous. For example, in one case, the support comprises paper. The inventors have found that a porous support such as paper is particularly suitable for the present invention; the porous (e.g. paper) layer abuts the amorphous solid layer and forms a strong bond. The amorphous solid is formed by drying a gel and, without being limited by theory, it is thought that the slurry from which the gel is formed partially impregnates the porous support (e.g. paper) so that when the gel sets and forms cross-links, the support is partially bound into the gel. This provides a strong binding between the gel and the support (and between the dried gel and the support).

Additionally, surface roughness may contribute to the strength of bond between the amorphous material and the support. The inventors have found that the paper roughness (for the surface abutting the support) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the support facing away from the amorphous solid may be arranged in contact with the heater, and a smoother surface may provide more efficient heat transfer. Thus, in some cases, the support is disposed so as to have a rougher side abutting the amorphous material and a smoother side facing away from the amorphous material.

In one particular case, the support may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the paper-backed foil abuts the amorphous solid. The foil is substantially impermeable, thereby preventing water provided in the amorphous solid to be absorbed into the paper which could weaken its structural integrity.

In some cases, the support is formed from or comprises metal foil, such as aluminium foil. A metallic support may allow for better conduction of thermal energy to the amorphous solid. Additionally, or alternatively, a metal foil may function as a susceptor in an induction heating system. In particular embodiments, the support comprises a metal foil layer and a support layer, such as cardboard. In these embodiments, the metal foil layer may have a thickness of less than 20 μm, such as from about 1 μm to about 10 μm, suitably about 5 μm.

In some cases, the support may have a thickness of between about 0.017 mm and about 2.0 mm, suitably from about 0.02 mm, 0.05 mm or 0.1 mm to about 1.5 mm, 1.0 mm, or 0.5 mm.

In some cases, the aerosol generating substrate may comprise embedded heating means, such as resistive or inductive heating elements. For example, the heating means may be embedded in the amorphous solid.

The amorphous solid may be made from a gel, and this gel may additionally comprise a solvent, included at 0.1-50 wt %. However, the inventors have established that the inclusion of a solvent in which the flavor is soluble may reduce the gel stability and the flavor may crystallise out of the gel. As such, in some cases, the gel does not include a solvent in which the flavor is soluble.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

An aspect of the present invention relates to an article. A consumable is an article, part or all of which is intended to be consumed during use by a user. A consumable may comprise or consist of aerosol-generating material. A consumable may comprise one or more other elements, such as a filter or an aerosol modifying substance. A consumable may comprise a heating element that emits heat to cause the aerosol-generating material to generate aerosol in use. The heating element may, for example, comprise combustible material, or may comprise a susceptor that is heatable by penetration with a varying magnetic field.

Articles of the present invention may be provided in any suitable shape. In some examples, the article is provided as a rod (e.g. substantially cylindrical). An article provided as a rod may include the aerosol-generating material as a shredded sheet, optionally blended with cut tobacco. Alternatively, or additionally, the article provided as a rod may include the aerosol-generating material as a sheet, such as a sheet circumscribing a rod of aerosol-generating material (e.g. tobacco). In some embodiments, the article comprises a layer portion of aerosol-generating material disposed on a carrier. In examples, the article may have at least one substantially planar (flat) surface.

A susceptor is material that is heatable by penetration with a varying magnetic field, such as an alternating magnetic field. The heating material may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The heating material may be both electrically-conductive and magnetic, so that the heating material is heatable by both heating mechanisms.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating.

In some embodiments, the susceptor is in the form of a closed circuit. It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In some cases, the amorphous solid does not comprise any inorganic filler materials. In particular cases, the amorphous solid comprises no calcium carbonate such as chalk.

In some cases, the aerosol-generating material does not comprise any inorganic filler materials. In particular cases, the aerosol-generating material does not comprise calcium carbonate such as chalk.

In particular embodiments which include filler, the filler is fibrous. For example, the filler may be a fibrous organic filler material such as wood pulp, hemp fiber, cellulose or cellulose derivatives. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosol-generating material.

In some embodiments, the amorphous solid does not comprise tobacco fibers. In particular embodiments, the amorphous solid does not comprise fibrous material.

In some embodiments, the aerosol generating material does not comprise tobacco fibers. In particular embodiments, the aerosol generating material does not comprise fibrous material.

In some embodiments, the aerosol generating substrate does not comprise tobacco fibers. In particular embodiments, the aerosol generating substrate does not comprise fibrous material.

In some embodiments, the aerosol-generating article does not comprise tobacco fibers. In particular embodiments, the aerosol-generating article does not comprise fibrous material.

In some cases, the amorphous solid may consist essentially of, or consist of a gelling agent, an aerosol generating agent, a tobacco material and/or a nicotine source, water, and optionally a flavor.

The aerosol generating material comprising the amorphous solid may have any suitable area density, such as from 30 g/m$^2$ to 120 g/m$^2$. In some embodiments, aerosol generating material may have an area density of from about 30 to 70 g/m$^2$, or about 40 to 60 g/m$^2$. In some embodiments, the amorphous solid may have an area density of from about 80 to 120 g/m$^2$, or from about 70 to 110 g/m$^2$, or particularly from about 90 to 110 g/m$^2$. Such area densities may be particularly suitable where the aerosol-generating material is included in an aerosol-generating article/assembly in sheet form, or as a shredded sheet (described further hereinbelow).

An aspect of the invention provides non-combustible aerosol provision system comprising an article according as described herein and non-combustible aerosol provision device comprising a heater which is configured to heat not burn the aerosol-generating article. A non-combustible aerosol provision system may also be referred to as an aerosol generating assembly. A non-combustible aerosol provision device may be referred to as an aerosol generating apparatus.

The heater may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosol-generating material is inserted or otherwise located in use. Alternatively or in addition, one or more susceptors may be provided in the aerosol-generating material. Other heating arrangements may also be used.

In some cases, in use, the heater may heat, without burning, the aerosol-generating material to a temperature equal to or less than 350° C., such as between 120° C. and 350° C. In some cases, the heater may heat, without burning, the aerosol-generating material to between 140° C. and 250° C. in use, or between 220° C. and 280° C. In some cases in use, substantially all of the amorphous solid is less than about 4 mm, 3 mm, 2 mm or 1 mm from the heater. In some cases, the solid is disposed between about 0.010 mm and 2.0 mm from the heater, suitably between about 0.02 mm and 1.0 mm, suitably 0.1 mm to 0.5 mm. These minimum distances may, in some cases, reflect the thickness of a support that supports the amorphous solid. In some cases, a surface of the amorphous solid may directly abut the heater.

The heater is configured to heat not burn the aerosol-generating article, and thus the aerosol-generating material. The heater may be, in some cases, a thin film, electrically resistive heater. In other cases, the heater may comprise an induction heater or the like. The heater may be a combustible heat source or a chemical heat source which undergoes an exothermic reaction to product heat in use. The aerosol generating assembly may comprise a plurality of heaters. The heater(s) may be powered by a battery.

The aerosol-generating article may additionally comprise a cooling element and/or a filter. The cooling element, if present, may act or function to cool gaseous or aerosol components. In some cases, it may act to cool gaseous components such that they condense to form an aerosol. It may also act to space the very hot parts of the non-combustible aerosol provision device from the user. The filter, if present, may comprise any suitable filter known in the art such as a cellulose acetate plug.

In some cases, the aerosol generating assembly may be a heat-not-burn device. That is, it may contain a solid tobaccocontaining material (and no liquid aerosol-generating material). In some cases, the amorphous solid may comprise the tobacco material. A heat-not-burn device is disclosed in WO 2015/062983 A2, which is incorporated by reference in its entirety.

In some cases, the aerosol generating assembly may be an electronic tobacco hybrid device. That is, it may contain a solid aerosol-generating material and a liquid aerosol-generating material. In some cases, the amorphous solid may comprise nicotine. In some cases, the amorphous solid may comprise a tobacco material. In some cases, the amorphous solid may comprise a tobacco material and a separate nicotine source. The separate aerosol-generating materials may be heated by separate heaters, the same heater or, in one case, a downstream aerosol-generating material may be heated by a hot aerosol which is generated from the upstream aerosol-generating material. An electronic tobacco hybrid device is disclosed in WO 2016/135331 A1, which is incorporated by reference in its entirety.

The aerosol-generating article (which may be referred to herein as an article, a cartridge or a consumable) may be adapted for use in a THP, an electronic tobacco hybrid device or another aerosol generating device. In some cases, the article may additionally comprise a filter and/or cooling element (which have been described above). In some cases, the aerosol-generating article may be circumscribed by a wrapping material such as paper.

The aerosol-generating article may additionally comprise ventilation apertures. These may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

In some cases, the aerosol generating material may be included in the article/assembly in sheet form. In some cases, the aerosol generating material may be included as a planar sheet. In some cases, the aerosol generating material may be included as a planar sheet, as a bunched or gathered sheet, as a crimped sheet, or as a rolled sheet (i.e. in the form of a tube). In some such cases, the amorphous solid of these embodiments may be included in an aerosol-generating article/assembly as a sheet, such as a sheet circumscribing a rod of aerosol-generating material (e.g. tobacco). In some other cases, the aerosol generating material may be formed as a sheet and then shredded and incorporated into the article. In some cases, the shredded sheet may be mixed with cut rag tobacco and incorporated into the article.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the aerosol generating material is formed as a sheet and then shredded and incorporated into an aerosol-generating article. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the aerosol generating material is included in an aerosol-generating article/assembly as a rolled sheet, suitably in the form of a tube.

The assembly may comprise an integrated aerosol-generating article and heater, or may comprise a heater device into which the article is inserted in use.

Figure 2:
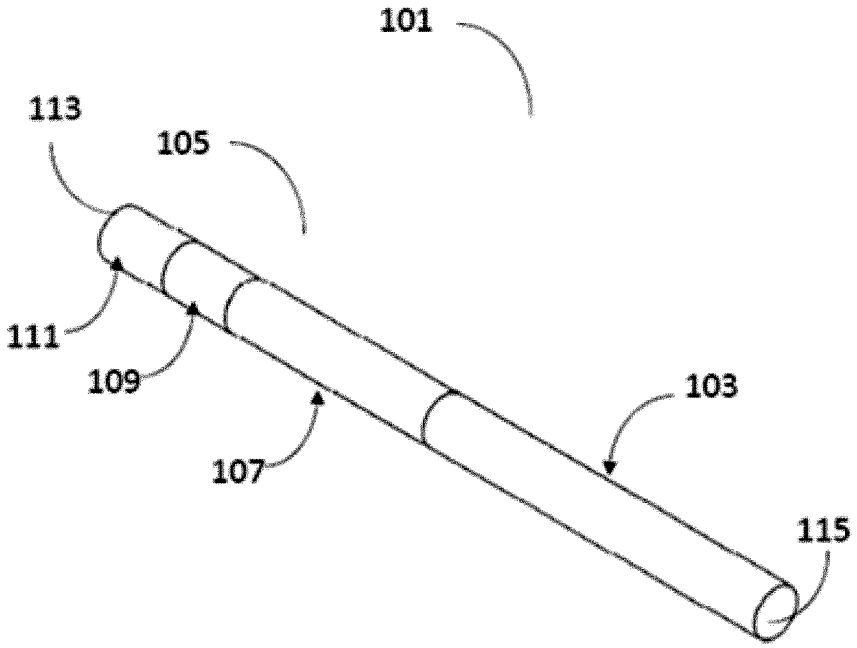
FIG. 2 shows a perspective view of the article of FIG. 1.

Referring to FIGS. 1 and 2, there are shown a partially cut-away section view and a perspective view of an example of an aerosol-generating article 101. The article 101 is adapted for use with a device having a power source and a heater. The article 101 of this embodiment is particularly suitable for use with the device 51 shown in FIGS. 5 to 7, described below. In use, the article 101 may be removably inserted into the device shown in FIG. 5 at an insertion point 20 of the device 51.

The article 101 of one example is in the form of a substantially cylindrical rod that includes a body of aerosol generating material 103 and a filter assembly 105 in the form of a rod. The aerosol generating material comprises the amorphous solid material described herein. In some embodiments, it may be included in sheet form. In some embodiments it may be included in the form of a shredded sheet. In some embodiments, the aerosol generating material described herein may be incorporated in sheet form and in shredded form.

The filter assembly 105 includes three segments, a cooling segment 107, a filter segment 109 and a mouth end segment 111. The article 101 has a first end 113, also known as a mouth end or a proximal end and a second end 115, also known as a distal end. The body of aerosol generating material 103 is located towards the distal end 115 of the article 101. In one example, the cooling segment 107 is located adjacent the body of aerosol generating material 103 between the body of aerosol generating material 103 and the filter segment 109, such that the cooling segment 107 is in an abutting relationship with the aerosol generating material 103 and the filter segment 103. In other examples, there may be a separation between the body of aerosol generating material 103 and the cooling segment 107 and between the body of aerosol generating material 103 and the filter segment 109. The filter segment 109 is located in between the cooling segment 107 and the mouth end segment 111. The mouth end segment 111 is located towards the proximal end 113 of the article 101, adjacent the filter segment 109. In one example, the filter segment 109 is in an abutting relationship with the mouth end segment 111. In one embodiment, the total length of the filter assembly 105 is between 37 mm and 45 mm, more preferably, the total length of the filter assembly 105 is 41 mm.

In one example, the rod of aerosol generating material 103 is between 34 mm and 50 mm in length, suitably between 38 mm and 46 mm in length, suitably 42 mm in length.

In one example, the total length of the article 101 is between 71 mm and 95 mm, suitably between 79 mm and 87 mm, suitably 83 mm.

An axial end of the body of aerosol generating material 103 is visible at the distal end 115 of the article 101. However, in other embodiments, the distal end 115 of the article 101 may comprise an end member (not shown) covering the axial end of the body of aerosol generating material 103.

The body of aerosol generating material 103 is joined to the filter assembly 105 by annular tipping paper (not shown), which is located substantially around the circumference of the filter assembly 105 to surround the filter assembly 105 and extends partially along the length of the body of aerosol generating material 103. In one example, the tipping paper is made of 58GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized components generated from the body of aerosol generating material 103 to flow. The cooling segment 107 is hollow to provide a chamber for aerosol accumulation yet rigid enough to withstand axial compressive forces and bending moments that might arise during manufacture and whilst the article 101 is in use during insertion into the device 51. In one example, the thickness of the wall of the cooling segment 107 is approximately 0.29 mm.

The cooling segment 107 provides a physical displacement between the aerosol generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the aerosol generating material 103 when it is heated by the device 51. If the physical displacement was not provided between the filter segment 109 and the body of aerosol generating material 103 and the heating elements of the device 51, then the temperature sensitive filter segment may 109 become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it is comprised of a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the article 101 is in use during insertion into the device 51.

The filter segment 109 may be formed of any filter material sufficient to remove one or more volatilized compounds from heated volatilized components from the aerosol generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimension. The capsule may in some cases, where present, contain a volatile component such as a flavorant or aerosol generating agent.

The density of the cellulose acetate tow material of the filter segment 109 controls the pressure drop across the filter segment 109, which in turn controls the draw resistance of the article 101. Therefore the selection of the material of the filter segment 109 is important in controlling the resistance to draw of the article 101. In addition, the filter segment performs a filtration function in the article 101.

In one example, the filter segment 109 is made of a 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the article is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity.

Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
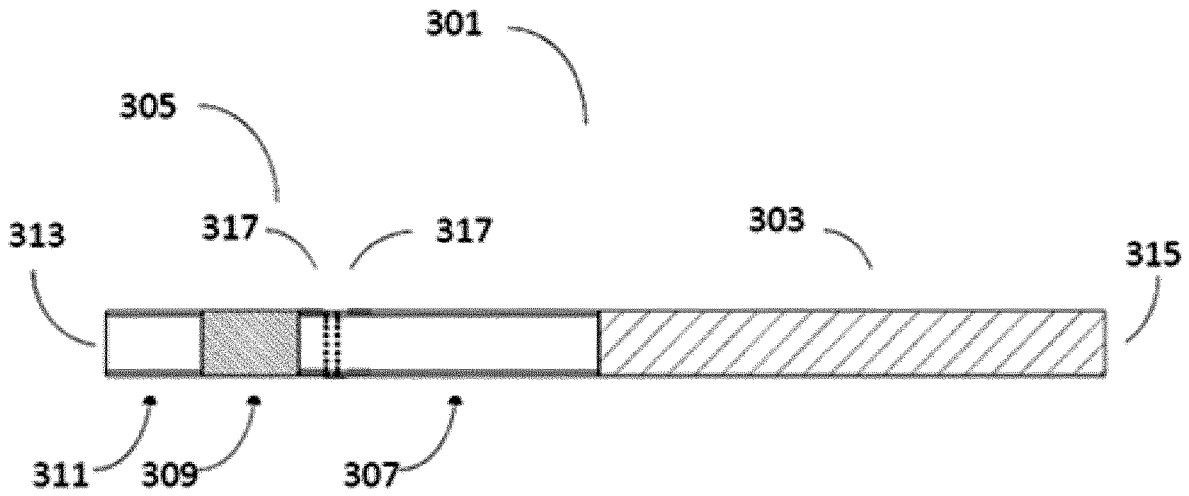
FIG. 3 shows a sectional elevation of an example of an aerosol-generating article.
Figure 4:
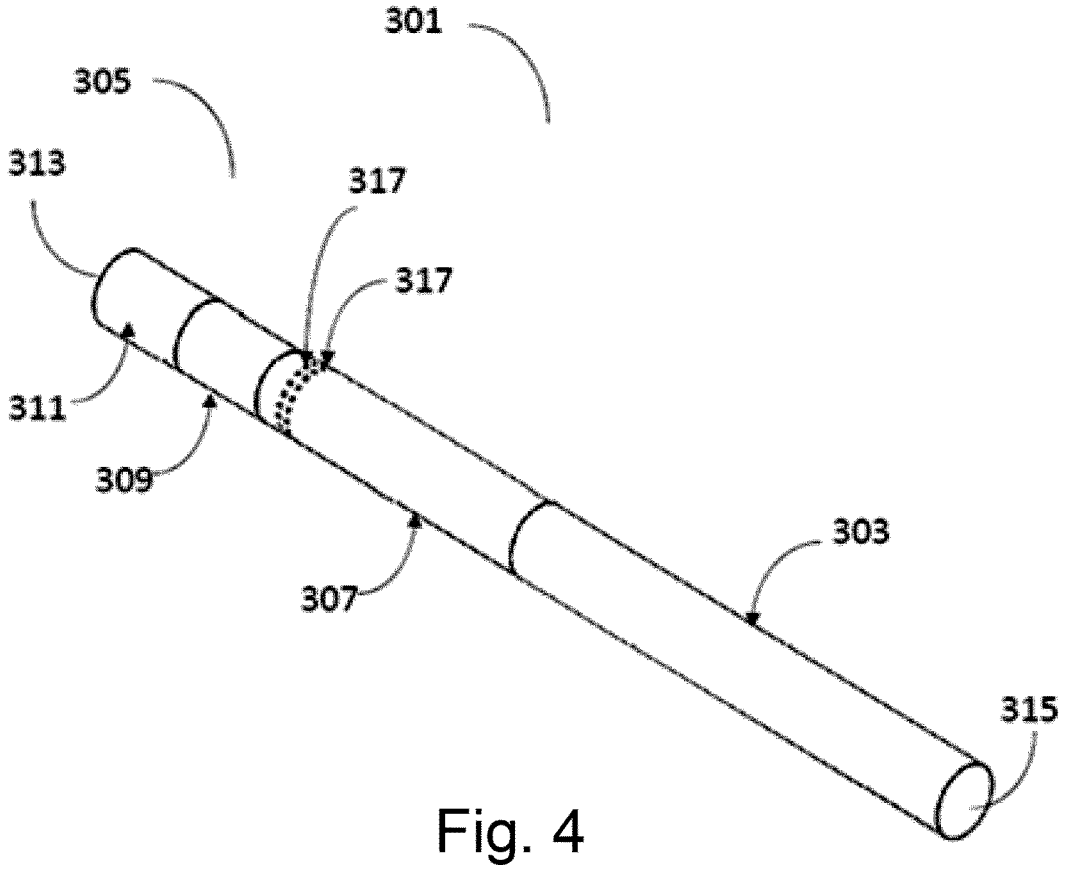
FIG. 4 shows a perspective view of the article of FIG. 3.

Referring to FIGS. 3 and 4, there are shown a partially cut-away section and perspective views of an example of an article 301. The reference signs shown in FIGS. 3 and 4 are equivalent to the reference signs shown in FIGS. 1 and 2, but with an increment of 200.

In the example of the article 301 shown in FIGS. 3 and 4, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and preferably, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, suitably between 17 mm and 20 mm from the proximal end 313 of the article 301. The location of the ventilation holes 317 is positioned such that user does not block the ventilation holes 317 when the article 301 is in use.

Figure 6:
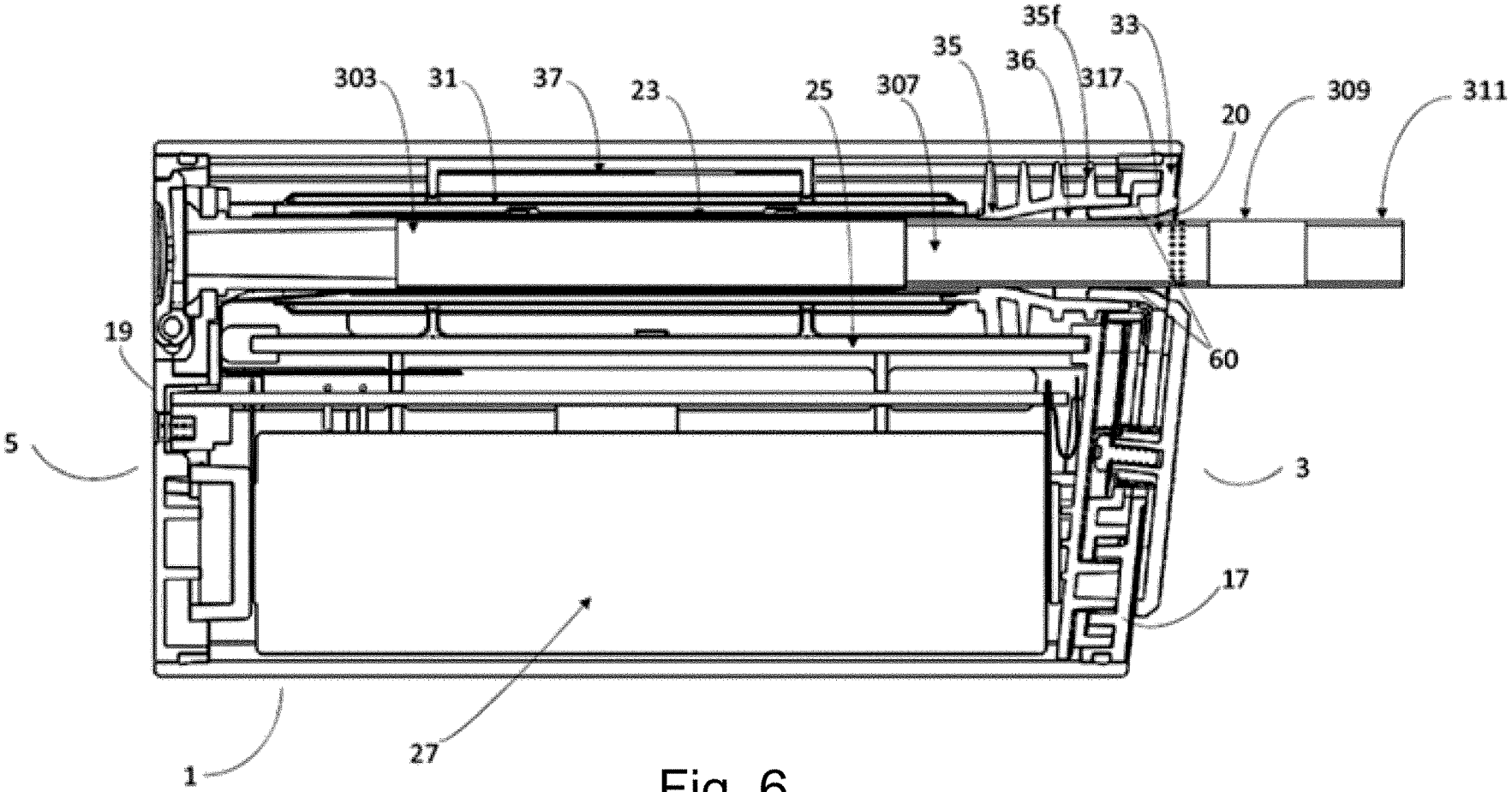
FIG. 6 shows a section view of an example of an aerosol generating assembly.
Figure 7:
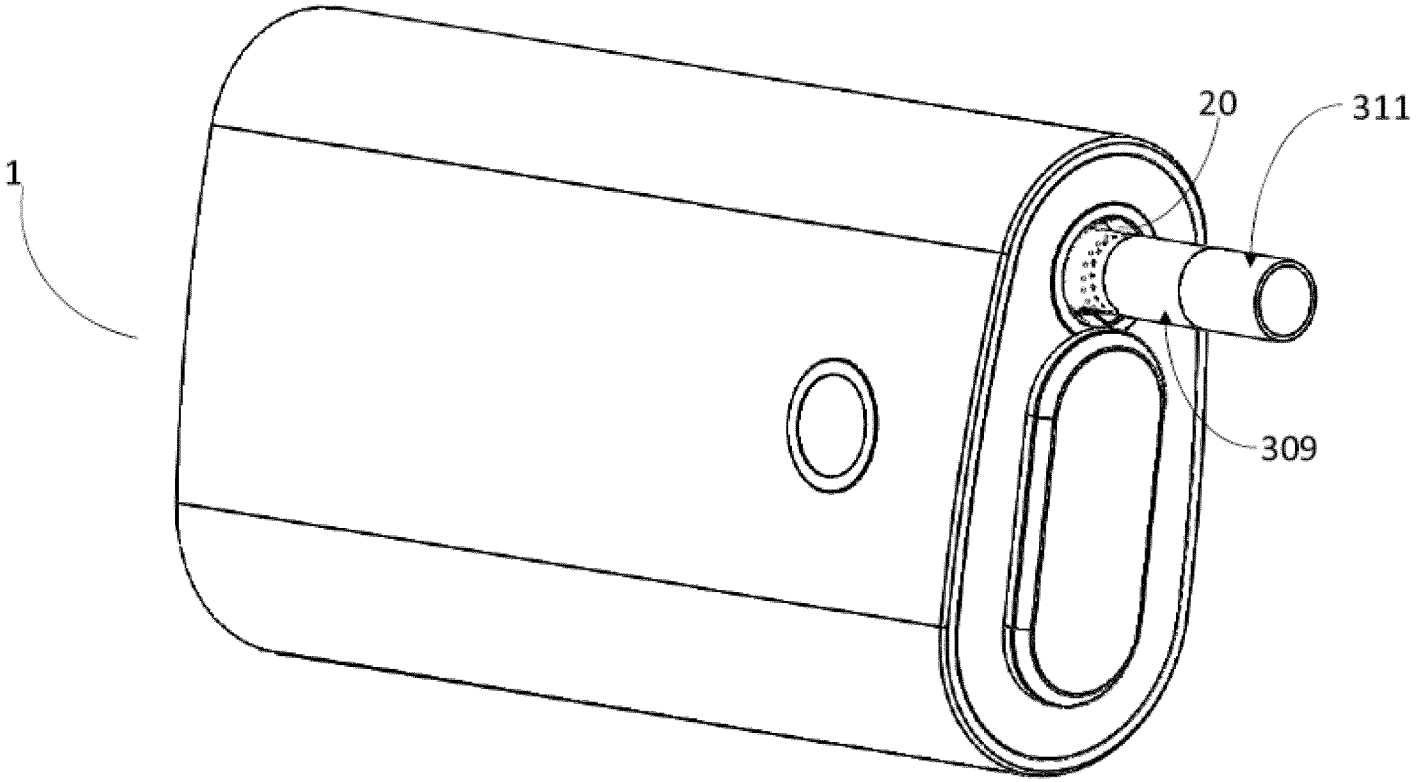
FIG. 7 shows a perspective view of an example of an aerosol generating assembly.

Providing the rows of ventilation holes between 17 mm and 20 mm from the proximal end 313 of the article 301 enables the ventilation holes 317 to be located outside of the device 51, when the article 301 is fully inserted in the device 51, as can be seen in FIGS. 6 and 7. By locating the ventilation holes outside of the device, non-heated air is able to enter the article 301 through the ventilation holes from outside the device 51 to aid with the cooling of the article 301.

The length of the cooling segment 307 is such that the cooling segment 307 will be partially inserted into the device 51, when the article 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the article 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
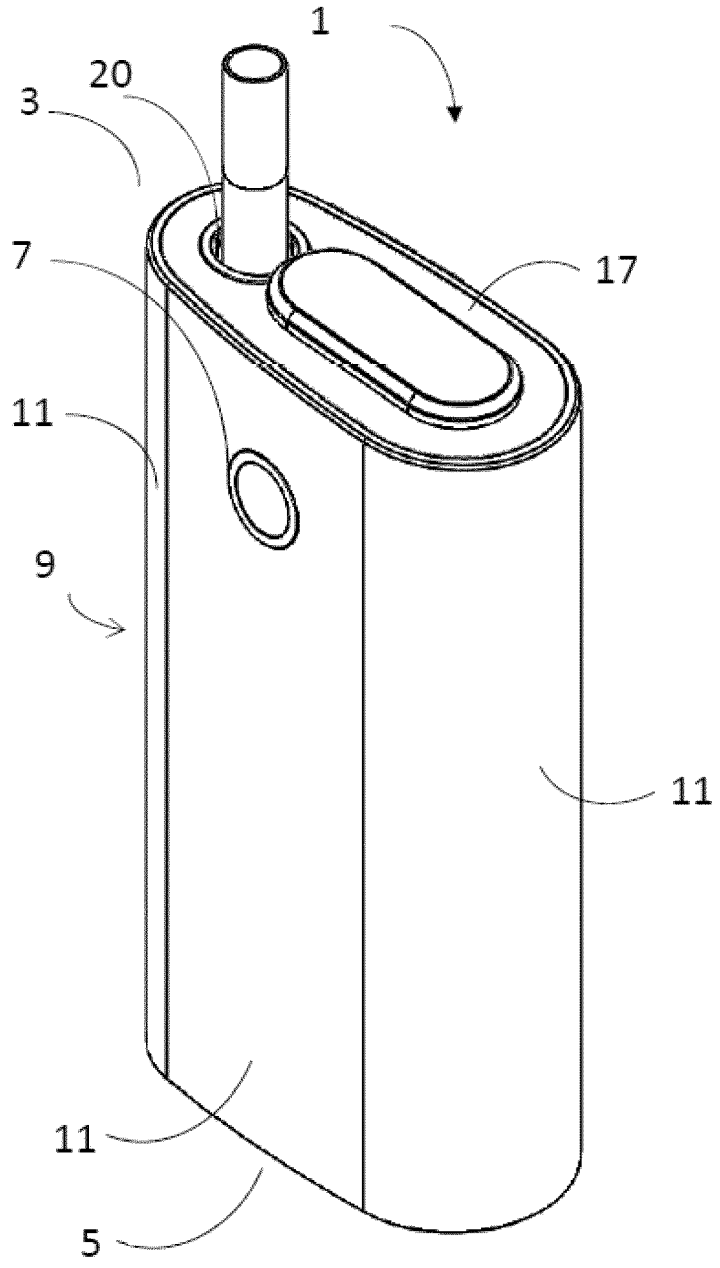
FIG. 5 shows a perspective view of an example of an aerosol generating assembly.

Referring now to FIGS. 5 to 7 in more detail, there is shown an example of a device 51 arranged to heat aerosol generating material to volatilize at least one component of said aerosol generating material, typically to form an aerosol which can be inhaled. The device 51 is a heating device which releases compounds by heating, but not burning, the aerosol generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 comprises a housing 59 for locating and protecting various internal components of the device 51. In the example shown, the housing 59 comprises a uni-body sleeve 11 that encompasses the perimeter of the device 51, capped with a top panel 17 which defines generally the 'top' of the device 51 and a bottom panel 19 which defines generally the 'bottom' of the device 51. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection moulding, and the uni-body sleeve 11 is made of aluminium, though other materials and other manufacturing processes may be used.

The top panel 17 of the device 51 has an opening 20 at the mouth end 53 of the device 51 through which, in use, the article 101, 301 including the aerosol generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol generating material in the article 101, 301 as discussed further below.

The power source 27 may be for example a battery, which may be a rechargeable battery or a non-rechargeable battery. Examples of suitable batteries include for example a lithium-ion battery, a nickel battery (such as a nickel—cadmium battery), an alkaline battery and/or the like. The battery 27 is electrically coupled to the heater arrangement 23 to supply electrical power when required and under control of the control circuitry 25 to heat the aerosol generating material in the article (as discussed, to volatilize the aerosol generating material without causing the aerosol generating material to burn).

An advantage of locating the power source 27 laterally adjacent to the heater arrangement 23 is that a physically large power source 25 may be used without causing the device 51 as a whole to be unduly lengthy. As will be understood, in general a physically large power source 25 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber 29 into which the article 101, 301 comprising the aerosol generating material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminium nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of aerosol generating material 103, 303 of the article 101, 301 is inserted into the heater arrangement 23 when the article 101, 301 is inserted into the device 51.

The or each heating element may be arranged so that selected zones of the aerosol generating material can be independently heated, for example in turn (over time, as discussed above) or together (simultaneously) as desired.

The heater arrangement 23 in this example is surrounded along at least part of its length by a thermal insulator 31. The insulator 31 helps to reduce heat passing from the heater arrangement 23 to the exterior of the device 51. This helps to keep down the power requirements for the heater arrangement 23 as it reduces heat losses generally. The insulator 31 also helps to keep the exterior of the device 51 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimise heat transfer by conduction and/or convection. Other arrangements for the insulator 31 are possible, including using heat insulating materials, including for example a suitable foam-type material, in addition to or instead of a double-walled sleeve.

The housing 59 may further comprises various internal support structures 37 for supporting all internal components, as well as the heating arrangement 23.

The device 51 further comprises a collar 33 which extends around and projects from the opening 20 into the interior of the housing 59 and a generally tubular chamber 35 which is located between the collar 33 and one end of the vacuum sleeve 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 101, 301 when it is inserted in the device 51 over at least part of the length of the hollow chamber 35. The air gap 36 is around all of the circumference of the article 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an article 101, 301 inserted into the device to assist in securing it within the device 51. Open spaces (not shown in the Figures) defined by adjacent pairs of ridges 60 and the article 101, 301 form ventilation paths around the exterior of the article 101, 301. These ventilation paths allow hot vapors that have escaped from the article 101, 301 to exit the device 51 and allow cooling air to flow into the device 51 around the article 101, 301 in the air gap 36.

In operation, the article 101, 301 is removably inserted into an insertion point 20 of the device 51, as shown in FIGS. 5 to 7. Referring particularly to FIG. 6, in one example, the body of aerosol generating material 103, 303, which is located towards the distal end 115, 315 of the article 101, 301, is entirely received within the heater arrangement 23 of the device 51. The proximal end 113, 313 of the article 101, 301 extends from the device 51 and acts as a mouthpiece assembly for a user.

In operation, the heater arrangement 23 will heat the article 101, 301 to volatilize at least one component of the aerosol generating material from the body of aerosol generating material 103, 303.

The primary flow path for the heated volatilized components from the body of aerosol generating material 103, 303 is axially through the article 101, 301, through the chamber inside the cooling segment 107, 307, through the filter segment 109, 309, through the mouth end segment 111, 313 to the user. In one example, the temperature of the heated volatilized components that are generated from the body of aerosol generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the article 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

Another aspect of the invention provides a method of making an aerosol-generating material according to the first aspect.

The method may comprise (a) forming a slurry comprising components of the amorphous solid or precursors thereof, (b) forming a layer of the slurry, (c) setting the slurry to form a gel, and (d) drying to form an amorphous solid.

The (b) forming a layer the of the slurry may comprise spraying, casting or extruding the slurry, for example. In some cases, the slurry layer is formed by electrospraying the slurry. In some cases, the slurry layer is formed by casting the slurry.

In some cases, (b) and/or (c) and/or (d) may, at least partially, occur simultaneously (for example, during electrospraying). In some cases, (b), (c) and (d) may occur sequentially.

In some cases, the slurry is applied to a support. The layer may be formed on a support.

In examples, the slurry comprises gelling agent, aerosol-former material and active substance.

The slurry may comprise these components in any of the proportions given herein in relation to the composition of the aerosol-generating material. For example, the slurry may comprise:

1-60 wt % of a gelling agent/gelling agent precursor; and 5-80 wt % of an aerosol-former material; and 10-60 wt % of an active substance;

wherein these weights are calculated on a dry weight basis, and wherein the gelling agent comprises alginate and pectin, wherein a ratio of the alginate to the pectin is from 1:1 to 10:1.

As described hereinabove, the ratio of alginate to pectin may influence the temperature range at which the active substance is released as part of an aerosol (the "release temperature range").

The ratio of alginate to pectin in the gelling agent may be selected as part of the method of making the aerosol-generating material in order to provide an aerosol-generating material having a predetermined release temperature range. The predetermined release temperature range may be selected to correspond to the temperature reached by the heater of the non-combustible aerosol provision system so that efficient/desirable release of active substance may be achieved.

Other parameters may also affect the temperature at which the aerosol-generating material releases active substance. For example, a parameter of the active substance may affect the temperature release range, such as the volatility of the active substance.

In examples, the method of producing an aerosol-generating material includes, before a), identifying the active substance to be included in the slurry, identifying a predetermined temperature to which the aerosol-generating material will be heated in a non-combustible aerosol provision device in use, determining the ratio of alginate to pectin to be included in the gelling agent based on the identified active substance and the identified predetermined temperature; and providing the gelling agent comprising alginate and pectin in the determined ratio. In this way, the release temperature range of the aerosol-generating material may be predetermined.

In some embodiments, the predetermined temperature is less than or equal to 350° C. In some embodiments, the predetermined temperature is from 220° C. to 280° C.

In some examples, the slurry has a viscosity of from about 10 to about 20 Pas at 46.5° C., such as from about 14 to about 16 Pas at 46.5° C.

The setting the gel (c) may comprise the addition of a setting agent to the slurry. For example, the slurry may comprise sodium, potassium or ammonium alginate as a gel-precursor, and a setting agent comprising a calcium source (such as calcium chloride), may be added to the slurry to form a calcium alginate gel.

In examples, the setting agent comprises or consists of calcium acetate, calcium formate, calcium carbonate, calcium hydrogencarbonate, calcium chloride, calcium lactate, or a combination thereof. In some examples, the setting agent comprises or consists of calcium formate and/or calcium lactate. In particular examples, the setting agent comprises or consists of calcium formate. The inventors have identified that, typically, employing calcium formate as a setting agent results in an amorphous solid having a greater tensile strength and greater resistance to elongation.

The total amount of the setting agent, such as a calcium source, may be 0.5-5 wt % (calculated on a dry weight basis). Suitably, the total amount may be from about 1 wt %, 2.5 wt % or 4 wt % to about 4.8 wt % or 4.5 wt %. The inventors have found that the addition of too little setting agent may result in an amorphous solid which does not stabilise the amorphous solid components and results in these components dropping out of the amorphous solid. The inventors have found that the addition of too much setting agent results in an amorphous solid that is very tacky and consequently has poor handleability.

When the amorphous solid does not contain tobacco, a higher amount of setting agent may need to be applied. In some cases the total amount of setting agent may therefore be from 0.5-12 wt % such as 5-10 wt %, calculated on a dry weight basis. Suitably, the total amount may be from about 5 wt %, 6 wt % or 7 wt % to about 12 wt % or 10 wt %. In this case the amorphous solid will not generally contain any tobacco.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the gel-precursor may comprise an alginate salt in which at least about 40%, 45%, 50%, 55%, 60% or 70% of the monomer units in the alginate copolymer are α-L-guluronic acid (G) units.

The drying (d) may, in some cases, remove from about 50 wt %, 60 wt %, 70 wt %, 80 wt % or 90 wt % to about 80 wt %, 90 wt % or 95 wt % (WWB) of water in the slurry.

The drying (d) may, in some cases, may reduce the cast material thickness by at least 80%, suitably 85% or 87%. For instance, the slurry may be cast at a thickness of 2 mm, and the resulting dried amorphous solid material may have a thickness of 0.2 mm.

The slurry itself may also form part of the invention. In some cases, the slurry solvent may consist essentially of or consist of water. In some cases, the slurry may comprise from about 50 wt %, 60 wt %, 70 wt %, 80 wt % or 90 wt % of solvent (WWB).

In cases where the solvent consists of water, the dry weight content of the slurry may match the dry weight content of the amorphous solid. Thus, the discussion herein relating to the solid composition is explicitly disclosed in combination with the slurry aspect of the invention.

According to an aspect of the present invention there is provided a method of generating an aerosol using a non-combustible aerosol provision system as described herein. In some embodiments, the method comprises heating the aerosol-generating material to a temperature of less than or equal to 350° C. In some embodiments, the method comprises heating the aerosol-generating material to a temperature of from about 220° C. to about 280° C. In some embodiments, the method comprises heating at least a portion of the aerosol-generating material to a temperature of from about 220° C. to about 280° C. over a session of use.

"Session of use" as used herein refers to a single period of use of the non-combustible aerosol provision system by a user. The session of use begins at the point at which power is first supplied to at least one heating unit present in the heating assembly. The device will be ready for use after a period of time has elapsed from the start of the session of use. The session of use ends at the point at which no power is supplied to any of the heating elements in the aerosol-generating device. The end of the session of use may coincide with the point at which the smoking article is depleted (the point at which the total particulate matter yield (mg) in each puff would be deemed unacceptably low by a user). The session will have a duration of a plurality of puffs. Said session may have a duration less than 7 minutes, or 6 minutes, or 5 minutes, or 4 minutes and 30 seconds, or 4 minutes, or 3 minutes and 30 seconds. In some embodiments, the session of use may have a duration of from 2 to 5 minutes, or from 3 to 4.5 minutes, or 3.5 to 4.5 minutes, or suitably 4 minutes. A session may be initiated by the user actuating a button or switch on the device, causing at least one heating element to begin rising in temperature.

In some embodiments, during a session of use, at least 20 wt % of the active substance present in the amorphous solid is aerosolized, or at least 30 wt %, 40 wt % or 50 wt %. In some embodiments the amorphous solid comprises menthol and, during a session of use, at least 20 wt % of the menthol present in the amorphous solid is aerosolized, or at least 30 wt %, 40 wt % or 50 wt %. That is, after a session of use, the amount of menthol in the amorphous solid is depleted by 20 wt %, 30 wt %, 40 wt % or 50 wt %. The ratio of alginate to pectin in the amorphous solid as described herein my allow for more efficient delivery of active substance to a user (e.g. a higher proportion of active substance is aerosolized from the amorphous solid).

According to an aspect of the invention there is provided use of the non-combustible aerosol provision system as described herein. Use of the non-combustible aerosol provision system may comprise interacting with the non-combustible aerosol provision device (e.g. activating an actuator) to initiate a smoking session.

Example 1

Three aerosol-generating materials were prepared according to the method described herein. Each composition was formed from slurries comprising gelling agent, aerosol-former material and active substance (menthol). The slurries used to form each composition differed only in the composition of the gelling agent.

The first composition comprised alginate in the absence of pectin. The second composition comprised pectin in the absence of alginate. The third composition comprised a combination of pectin and alginate.

Figure 8:
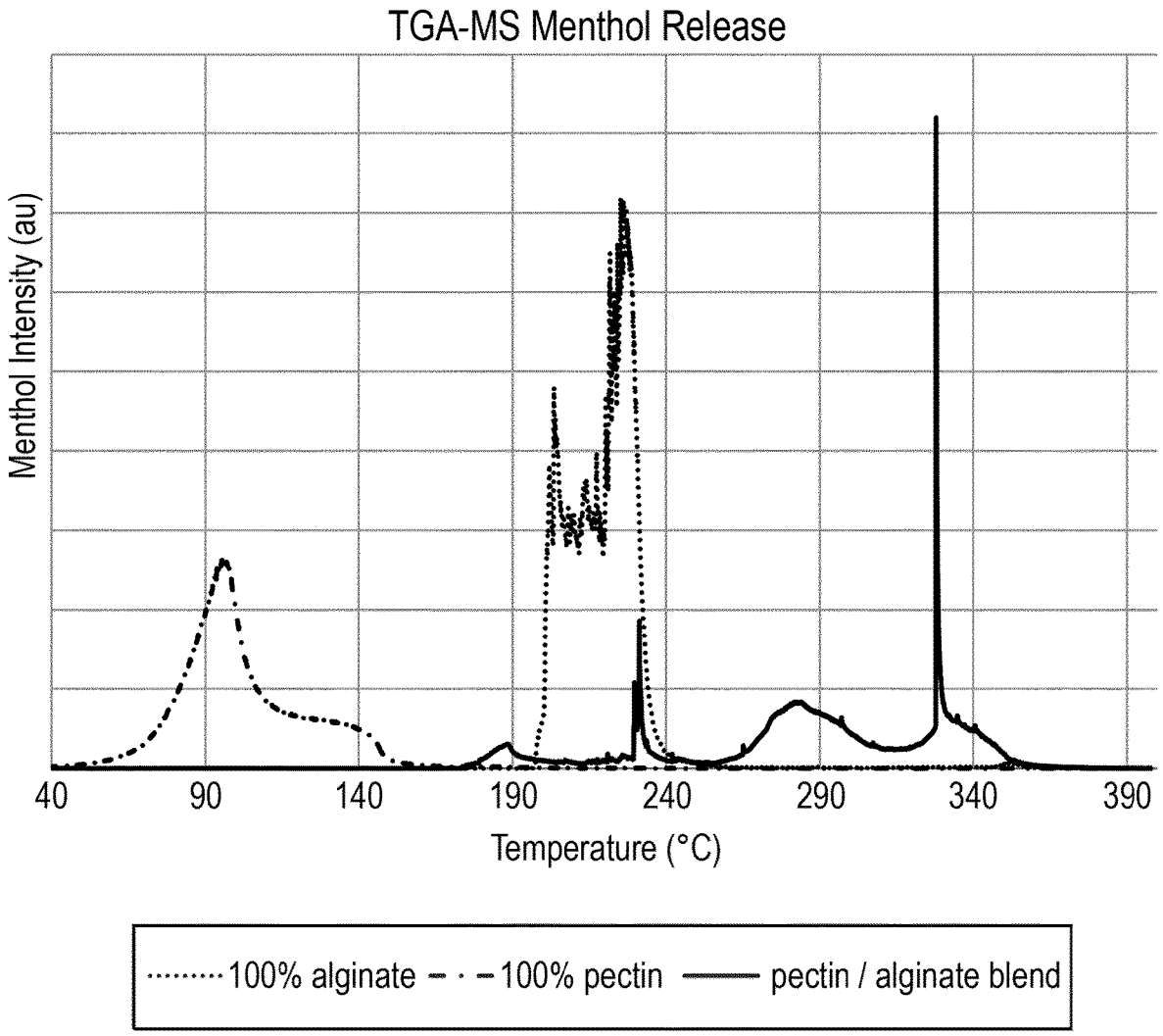
FIG. 8 shows thermogravimetric analysis-mass spectra of examples of aerosol-generating materials.

FIG. 8 shows thermogravimetric analysis-mass spectra (obtained from a Thermogravimetric Analyser coupled to a Mass Spectrometer a (TGA-MS system)) illustrating the effect of gelling agent composition on the release temperature range of menthol from an aerosol-generating material. The TGA was set to equilibrate to 40° C., after which the temperature was increased at a rate of 10° C./min from 40 to 400° C. The MS was set to scan for ion fragments 71, 81 and 95 M/z (fragments of menthol having high intensity). The MS began sampling when the TGA reached 40° C.

The first aerosol-generating material had a release temperature range of from about 200° C. to 230° C. The second aerosol-generating material had a release temperature range of from about 80° C. to 150° C. The third aerosol-generating material included two distinct release temperature ranges: first, from about 270° C. to 300° C., and second, from about 330° C. to 345° C.

Example 2

Two aerosol-generating materials were prepared according to the method described herein. The slurries used to prepare the aerosol-generating materials differed only in the composition of the gelling agent. The gelling agent of the first material comprised alginate in the absence of pectin; the gelling agent of the second material comprised 80% alginate and 20% pectin by dry weight.

It was found that the viscosity of the slurry used to prepare the second material was lower than that of the first material, and thus was easier to process (less water was required in the preparation of the aerosol-generating material, thereby reducing the evaporative load during the drying). It was therefore found that producing the second material was faster and less energy intensive than producing the first material.

Figure 9:
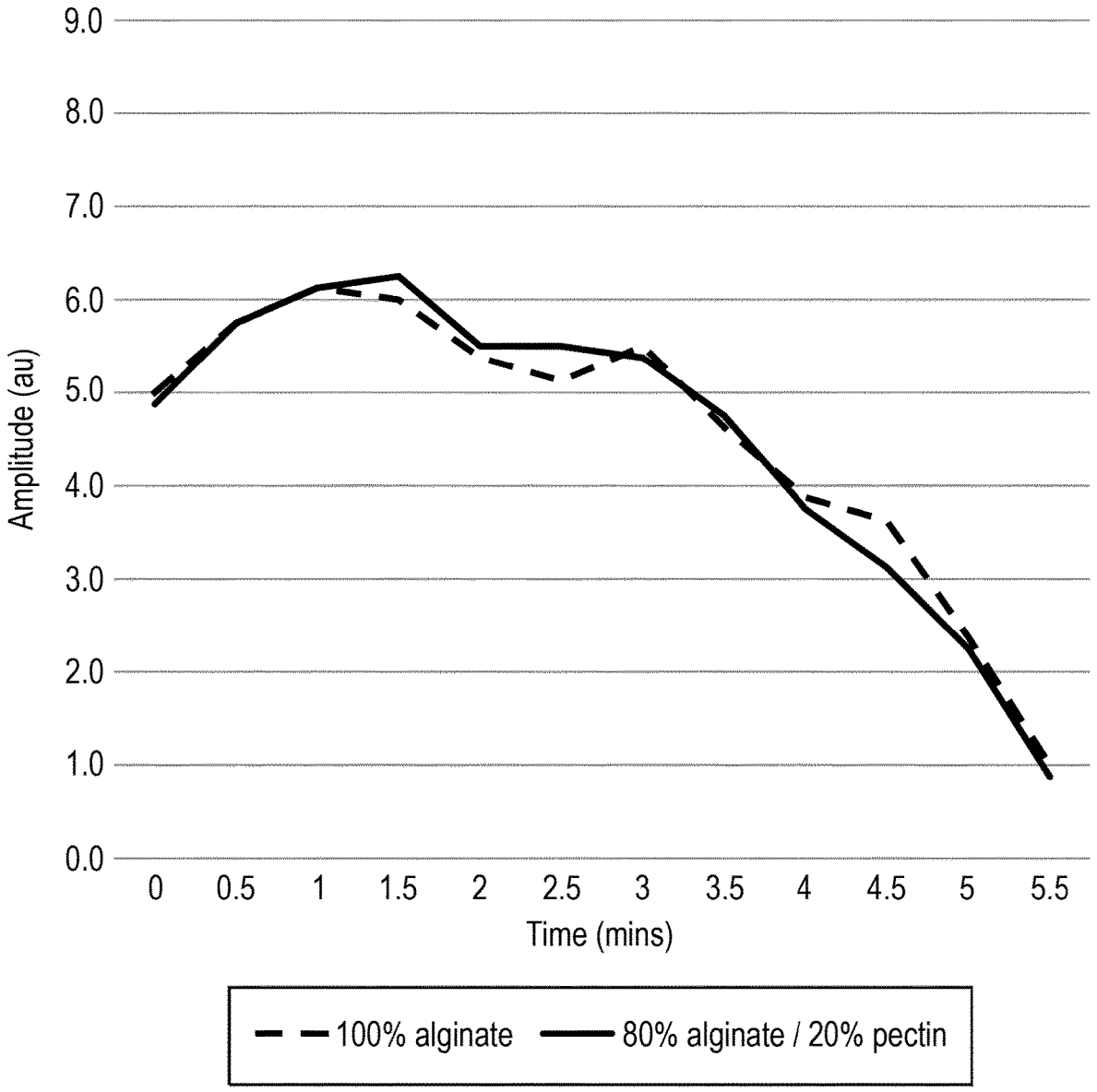
FIG. 9 shows sensory data for examples of aerosol-generating materials.

FIG. 9 shows sensorial data obtained for the two aerosol-generating materials. The materials were heated at a constant temperature over a period of 5.5 minutes, and the intensity of active consistent (menthol) was monitored. As can be seen from FIG. 9, the materials have very similar sensorial profiles. That is, the use of a gelling agent comprising alginate and pectin (in particular, wherein alginate is the majority component) instead of a gelling agent comprising alginate alone results in no deterioration in sensorial performance.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol-generating material comprising an amorphous solid, wherein the amorphous solid comprises:

1-60 wt % of a gelling agent;

5-80 wt % of an aerosol-former material; and 10-60 wt % of an active substance, the active substance consisting essentially of menthol;

wherein these weights are calculated on a dry weight basis, and wherein the gelling agent comprises alginate and pectin, wherein a ratio of the alginate to the pectin is from 5:1 to 10:1.

2. The aerosol-generating material according to claim 1, wherein the active substance comprises menthol in an amount of at least 95 wt % of the dry weight of the active substance.

3. The aerosol-generating material according to claim 1, wherein the amorphous solid comprises the aerosol-former material in an amount of 10-30 wt %.

4. The aerosol-generating material according to claim 1, wherein the amorphous solid comprises the active substance in an amount of 40-60 wt %.

5. The aerosol-generating material according to claim 1, wherein the amorphous solid comprises:

20-35 wt % of the gelling agent;

15-25 wt % of the aerosol-former material;

45-55 wt % of the active substance, the active substance consisting essentially of menthol;

wherein these weights are calculated on a dry weight basis, and wherein the ratio of alginate to pectin in the gelling agent is from 5:1 to 7:1.

6. The aerosol-generating material according to claim 1, wherein the alginate comprised in the gelling agent is present in the amorphous solid in an amount of from about 15-40 wt % of the amorphous solid on a dry weight basis and/or wherein the pectin comprised in the gelling agent is present in the amorphous solid in an amount of from about 3-10 wt % of the amorphous solid on a dry weight basis.

7. The aerosol-generating material according to claim 1, comprising from about 1 wt % to about 15 wt % of water (WWB).

8. The aerosol-generating material according claim 1, wherein the aerosol-former material is selected from one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

9. The aerosol-generating material according to claim 1, wherein the aerosol-former material is selected from erythritol, propylene glycol, glycerol and mixtures thereof.

10. The aerosol-generating material according to claim 1, wherein the amorphous solid does not comprise calcium carbonate.

11. The aerosol-generating material according to claim 1, wherein the amorphous solid does not comprise any inorganic filler material.

12. A substrate comprising an aerosol-generating material according to claim 1 and a support on which the aerosol-generating material is provided.

13. An article for use with a non-combustible aerosol provision device, the article comprising an aerosol-generating material according to claim 1.

14. A non-combustible aerosol provision system comprising an article according to claim 13 and a non-combustible aerosol provision device, wherein the non-combustible aerosol provision device is configured to generate aerosol from the article when the article is used with the non-combustible aerosol provision device, wherein the non-combustible aerosol provision device comprises a heater configured to heat but not burn the article, preferably wherein the heater is configured to heat the article to a temperature of less than 350° C. in use.

15. The system according to claim 14, wherein the article is provided as a rod.

16. A method of making an aerosol-generating material according to claim 1, the method comprising:

providing a slurry comprising the gelling agent, aerosol-former material and active substance;

forming a layer of the slurry;

setting the slurry to form a gel; and drying the gel to form the amorphous solid.

17. The method according to 16 comprising, before forming the slurry, identifying the active substance to be included in the slurry;

identifying a predetermined temperature to which the aerosol-generating material will be heated by a non-combustible aerosol provision device in use;

determining the ratio of alginate to pectin to be included in the gelling agent based on the identified active substance and the identified predetermined temperature; and providing the gelling agent comprising alginate and pectin in the determined ratio.

18. The method according to claim 16, wherein the predetermined temperature is from 220° C. to 280° C.

19. The method according to claim 16, wherein the setting the slurry comprises the addition of a setting agent to the slurry.

20. A method of generating an aerosol using a non-combustible aerosol provision system according to claim 14, the method comprising heating the aerosol-generating material to a temperature of less than 350° C.

21. The method according to claim 20 wherein, during a session of use, at least 20 wt % of the active substance present in the amorphous solid is aerosolised.

22. The non-combustible aerosol provision system according to claim 14, wherein the non-combustible aerosol provision system is configured to initiate a smoking session.

* * * * *